United States Patent [19]

Yanko

[11] Patent Number: 4,685,441

[45] Date of Patent: Aug. 11, 1987

[54] HEAT EXCHANGER

[76] Inventor: Kenneth C. Yanko, 39 Arlington Dr., Romeoville, Ill. 60441

[21] Appl. No.: 884,690

[22] Filed: Jul. 11, 1986

Related U.S. Application Data

[63] Continuation of Ser. No. 739,809, May 31, 1985, abandoned.

[51] Int. Cl.[4] ..... F24H 3/00

[52] U.S. Cl. ..... 126/116 R; 126/293; 126/110 R; 110/162; 110/235

[58] Field of Search ..... 165/150; 126/99 R, 110 R, 126/110 C, 116 R, 116 A, 99 A, 99 C, 99 D, 293, 290, 115, 127, 129, 80; 236/45, 1 G, 49; 110/162

[56] References Cited

U.S. PATENT DOCUMENTS

| | | | |
|---|---|---|---|
| 1,655,110 | 1/1928 | Steinhorst et al. | 126/116 R |
| 2,211,940 | 8/1940 | Stoner | 110/162 X |
| 2,504,315 | 4/1950 | Feuerfile | 126/116 R |
| 2,603,208 | 7/1952 | Beauchamp | 126/116 R |
| 4,432,337 | 2/1984 | Gregory | 126/121 |
| 4,483,258 | 11/1984 | John et al. | 110/235 |
| 4,487,137 | 12/1984 | Horvat et al. | 126/293 X |

*Primary Examiner*—Larry Jones
*Attorney, Agent, or Firm*—Ernest Kettelson

[57] ABSTRACT

A heat exchanger comprising a burner in a vertical heating chamber, having openings along its upper end to horizontally extending coils which pass through a plurality of heat transfer fins, the coils opening near the bottom edge of the assembly to a horizontally extending collector tube, open at one end and closed at the other. The open end of the collector tube opens to a vertical tubular stack through which outside air is blown past the opening to the collector tube thus creating a vacuum at that point to draw heated air from the heating chamber and through the coils where the heat is taken up by the heat transfer fins and transferred to air flowing through a hot air duct of a heating system in which the heat exchanger is placed. A blower connected in the bottom portion of the vertical stack draws outside air into the stack through an intake conduit at the bottom end and out through an exhaust conduit at the upper end of the stack. A damper is provided in the intake conduit to control the amount of air flowing into and through the stack.

9 Claims, 7 Drawing Figures

HEAT EXCHANGER

This application is a continuation of prior application Ser. No. 739,809 filed May 31, 1985, now abandoned.

BACKGROUND OF THE INVENTION

This invention relates to the field of heat exchangers in which heat is taken up by a series of coils from a heat source and transferred to air flowing in a hot air duct of a hot air heating system.

One of the major problems regarding heat exchangers which are presently known is relatively low efficiency. That is, the amount of heat actually transferred to the air being heated is a relatively low percentage of that actually available at the heat source. The present invention makes a marked improvement in efficiency and percentage of heat available at the source that is actually transferred to the air in an air duct which is to be heated.

Examples of prior art heat exchangers of which the inventor is aware include the one disclosed in U.S. Pat. No. 4,261,326, comprising a coil in which gases are drawn by a blower positioned to create negative atmospheric pressure at the exhaust end. U.S. Pat. No. 2,528,623 discloses another type of heating coil in which low pressure is induced at the exhaust end. U.S. Pat. No. 2,155,184 discloses an orchard heater having a series of laterally extending pipes through which the steam is flowed by a blower. U.S. Pat. No. 1,516,458 discloses a heating coil assembly through which hot gases are flowed with a blower creating the draft necessary to move the gases through the coils.

The present invention improves efficiency of the heat exchanger by providing a vacuum or "pulling force" which is downstream of the heat transfer coils, the vacuum being created by flowing outside relatively colder air in a stack transversely of the opening to the passageway from which the relatively hotter air is being drawn past the heat transfer coils. The relatively colder and heavier air in the transversely positioned stack tends to impede the entry of relatively hotter and lighter air into the transverse stack until its temperature has been significantly reduced. This enables the heated air from the burner and heating chamber to more or less flow through the heat transfer coils at its own pace allowing maximum take up and transfer of heat, until the temperature of the heated air is significantly lowered toward that of the outside air being flowed through the transverse stack. There is no "pushing force" upstream of the heat transfer coils, nor even any positive force of either the pushing or pulling variety in the hot air passageway of this invention that positively propels the hot air along at a constant rate as it passes through the heat transfer coils, forcing it to continue at that constant flow rate whether it has given up all of its heat to the heat transfer coils or not.

SUMMARY OF THE INVENTION

It is an object of the invention to provide a heat exchanger for transfer of heat from a heating source to air in the air duct of a hot air heating system with improved efficiency.

It is an object of the invention to provide a heat exchanger for transfer of heat from a heating source to air in the air duct of a hot air heating system, in which a vacuum is created downstream from the heat transfer passageway by flowing lower temperature air transversely across the opening to such passageway at such downstream location.

It is an object of the invention to provide a heat exchanger for transfer of heat from a heating source to air in the air duct of a hot air heating system, in which heated air is flowed through the heat transfer passageway at a rate which permits transfer of maximum heat from the heated air of the heat exchanger to the air in the air duct of the hot air heating system.

DESCRIPTION OF PREFERRED EMBODIMENT

Figure 1:
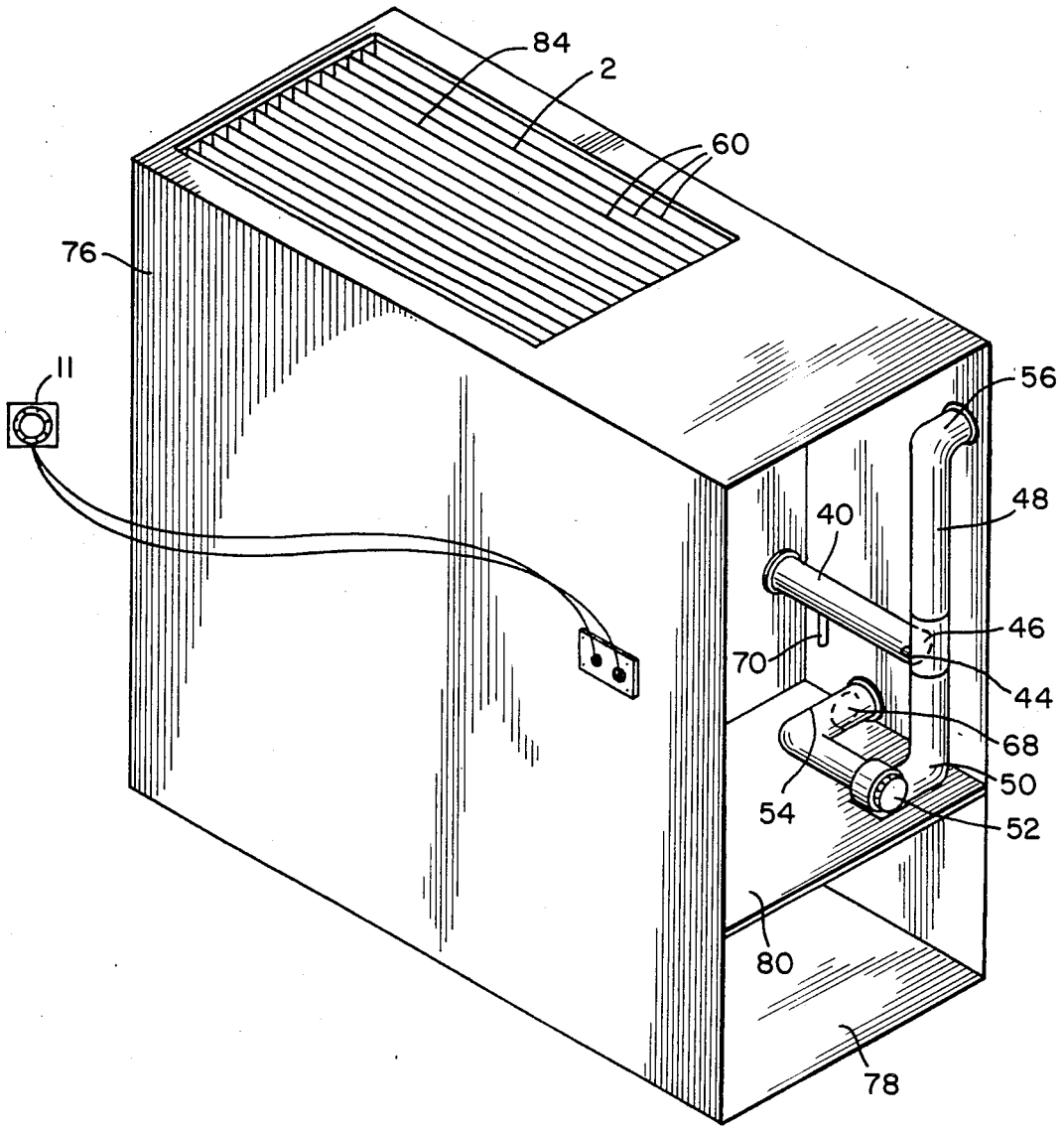
FIG. 1 is a perspective view of the housing of a hot air heating system having a heat exchanger in accordance with this invention mounted therein.
Figure 2:
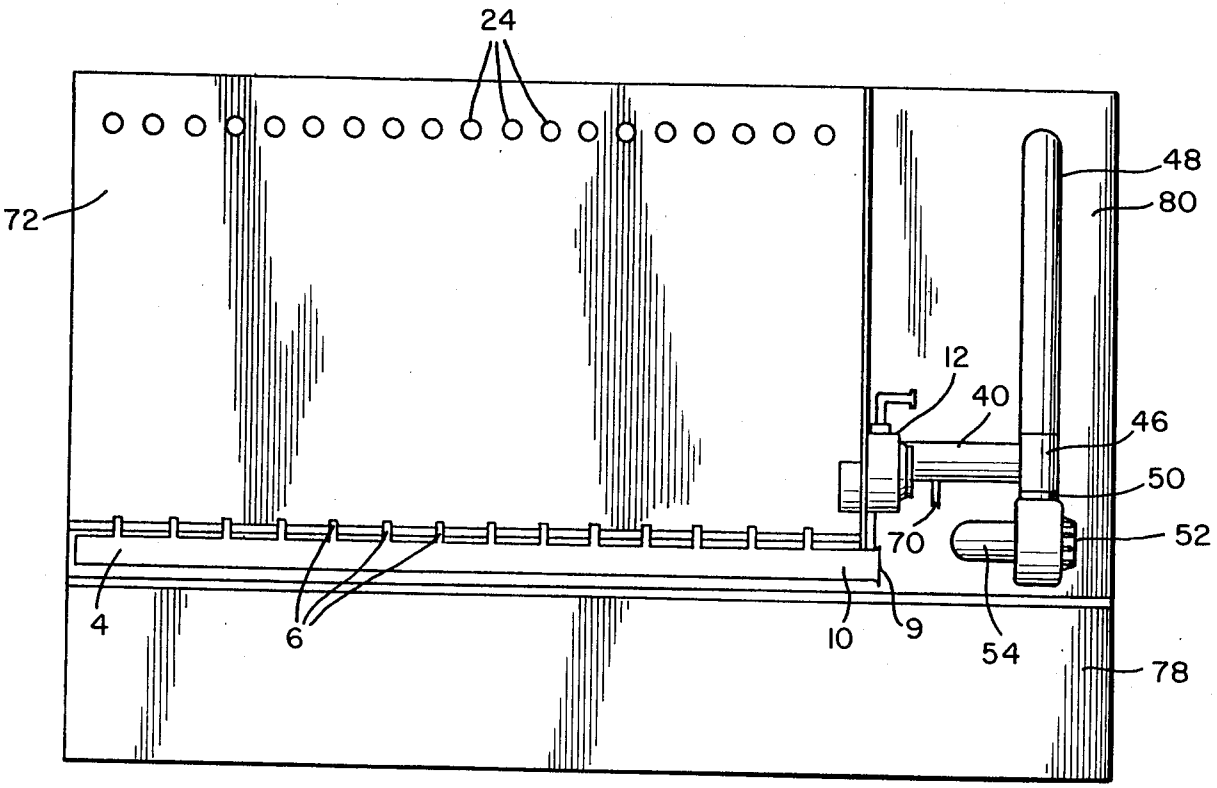
FIG. 2 is a side elevation view of the housing shown in FIG. 1 with the left hand side wall as seen in FIG. 1 removed, showing the inside of the burner and heating chamber normally closed by such side wall. The blower and associated connecting ducts are also visible.
Figure 3:
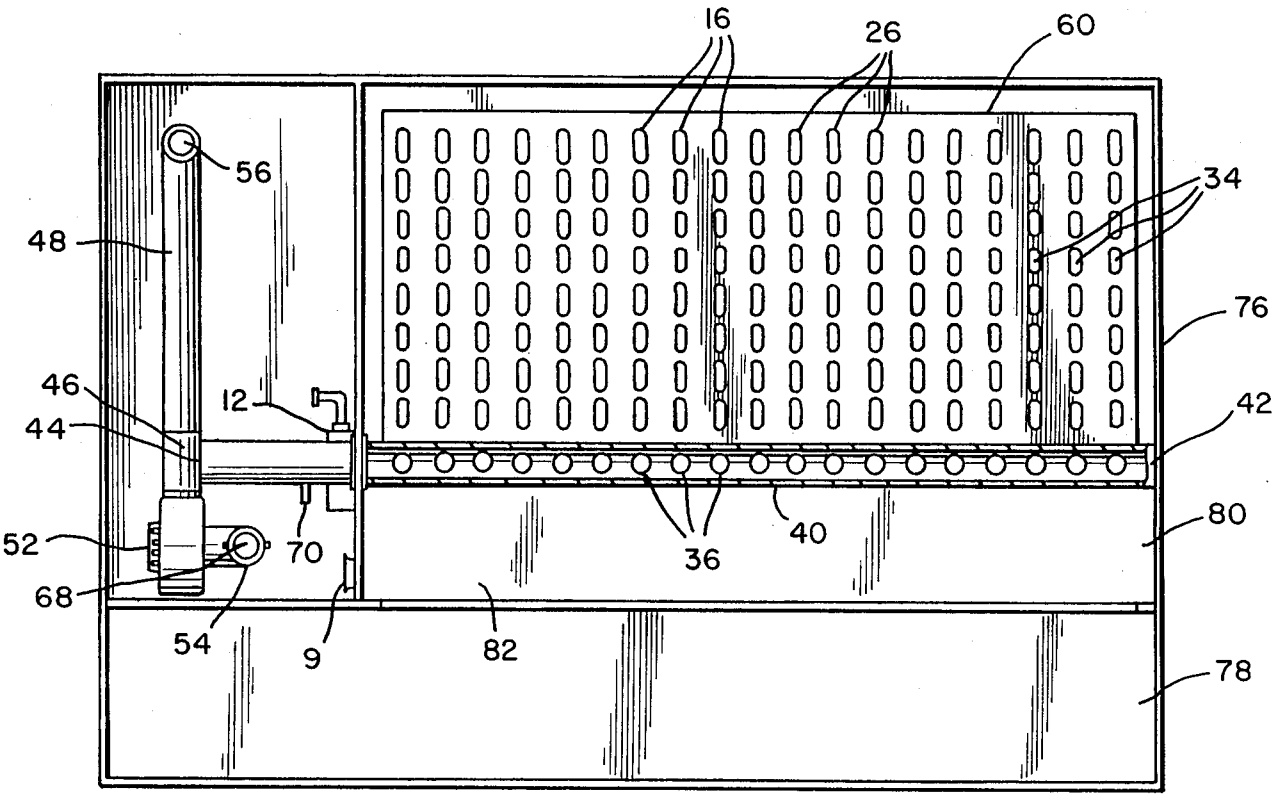
FIG. 3 is a side elevation view of the housing shown in FIG. 1 with the right hand side wall as seen in FIG. 1 removed, showing end views of the laterally extending heat exchange coils and the facing heat transfer aluminum fin. The collector tube is shown partly broken away to show the outlet apertures of the coils opening to the collector tube.
Figure 4:
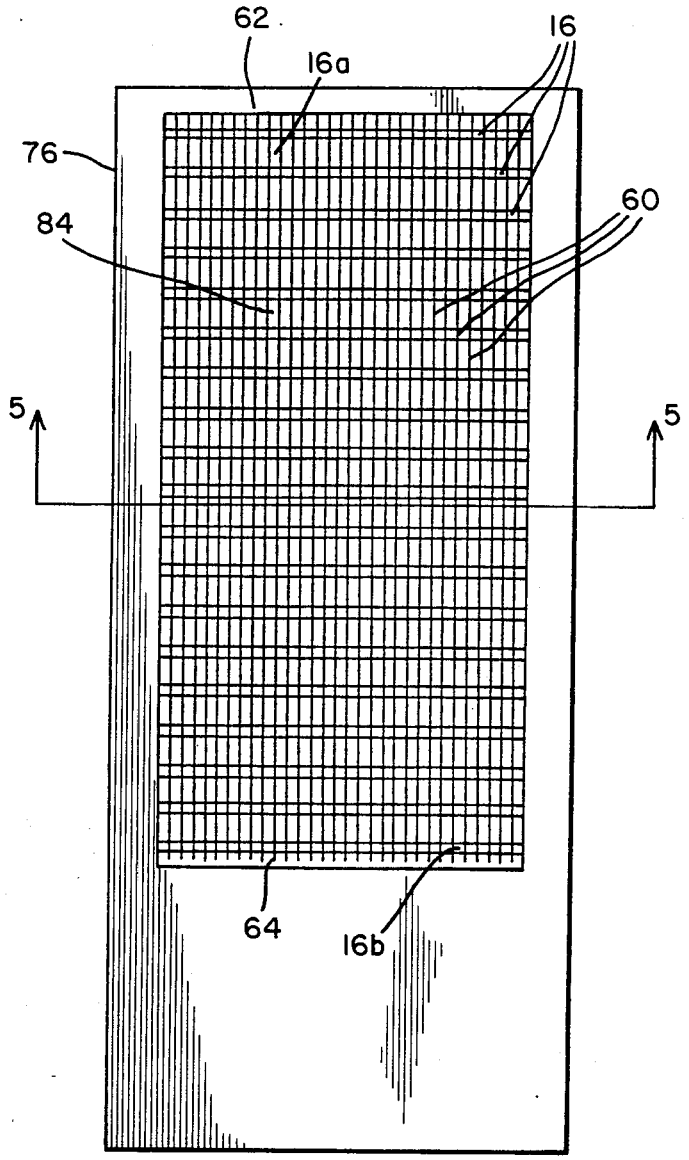
FIG. 4 is a top plan view of the housing seen in FIG. 1, with the heat exchange coils and heat transfer fins of the heat exchanger visible through the top opening.
Figure 5:
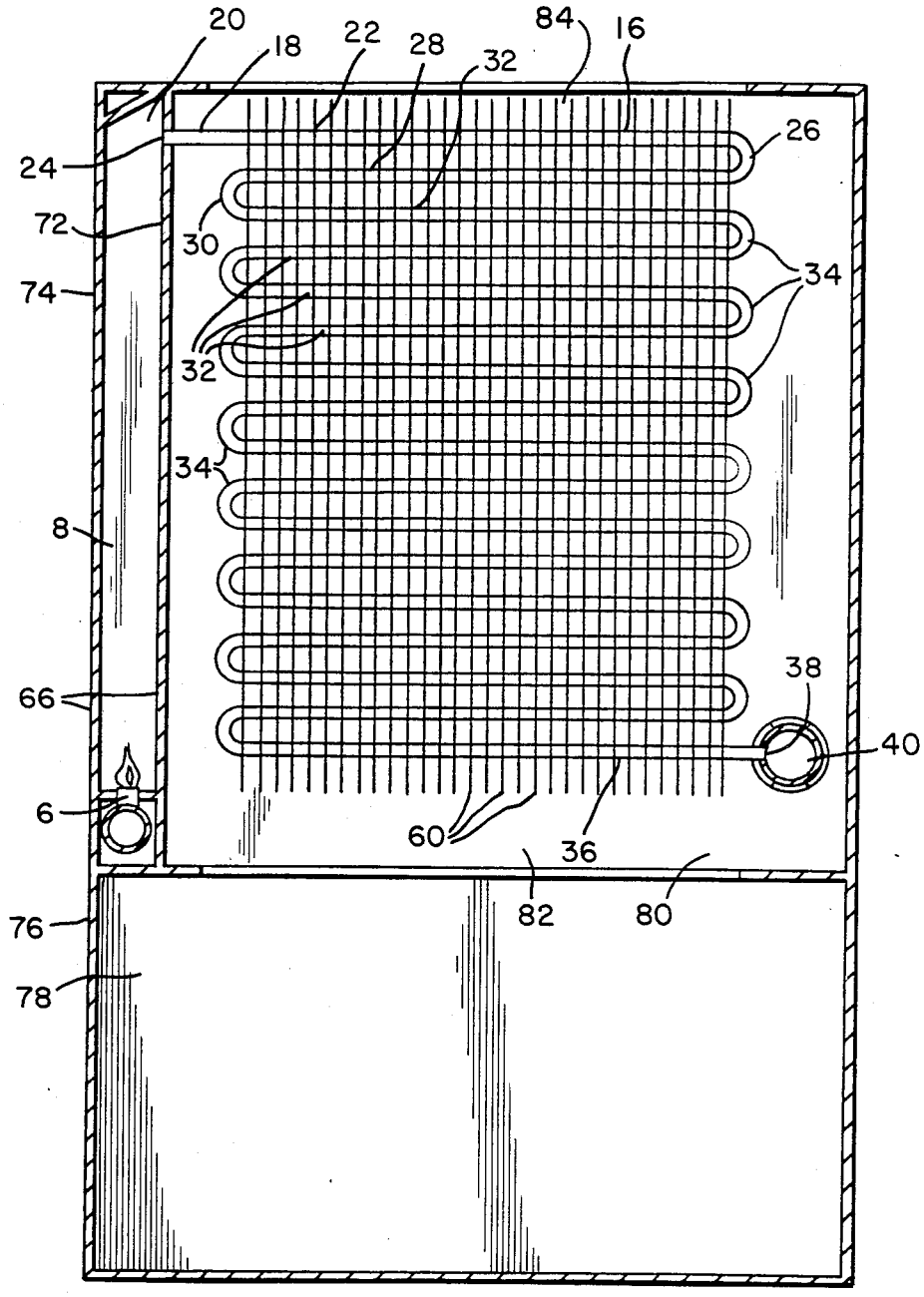
FIG. 5 is a section view taken on line 5—5 of FIG. 4.
Figure 6:
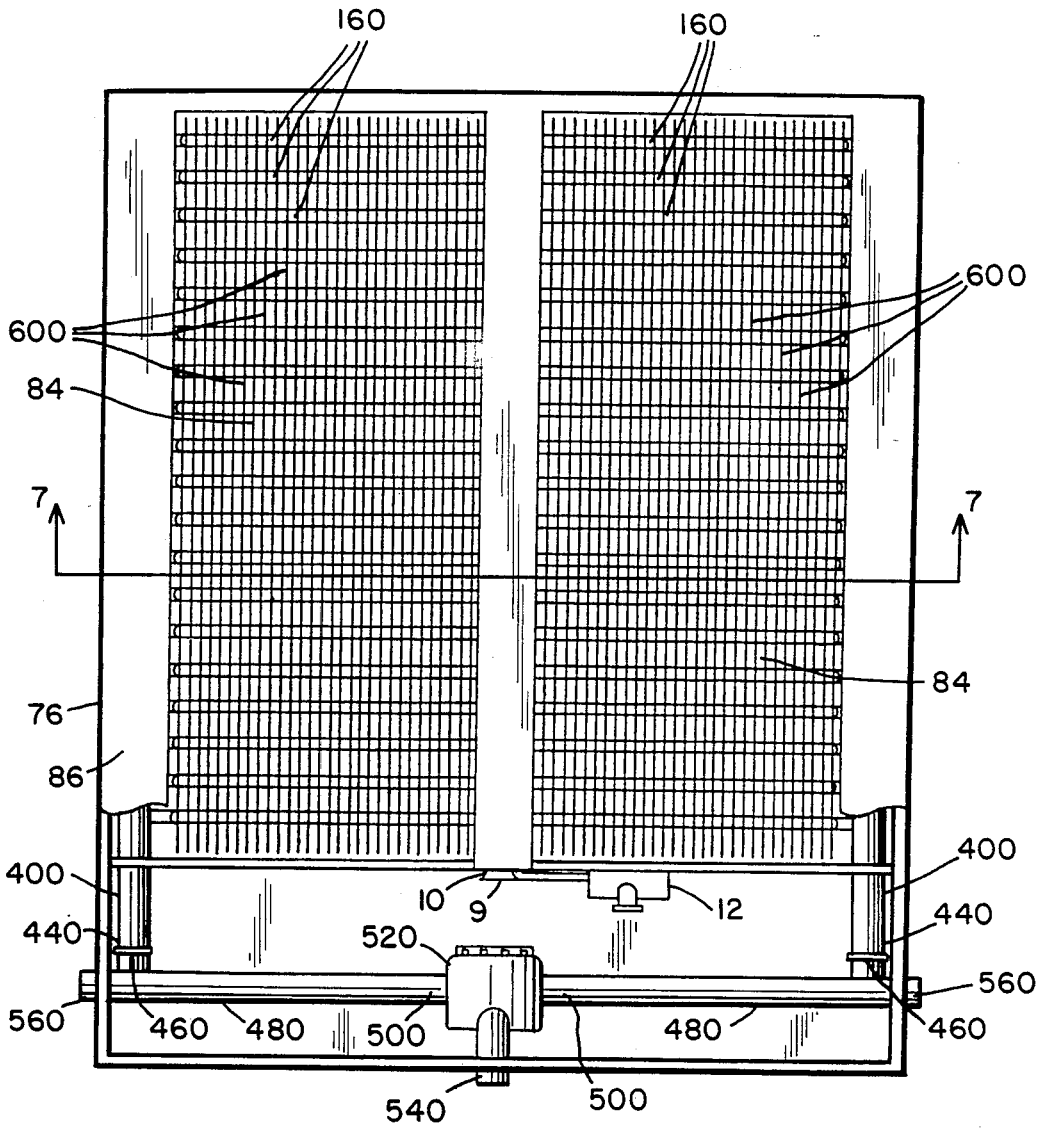
FIG. 6 is a top plan view of a modification of this invention, showing the top wall of a housing having two openings through which a modified heat exchanger is visible having two sets of heat exchange coils and fins, one set projecting from the right hand side of the burner and heating chamber, the other set projecting from the left hand side thereof. Part of the top wall of the housing is broken away to show the arrangement of other internal components in the front end of the housing.

A heat exchanger 2 for heating air in an air duct of a hot air heating system, comprising an elongated burner 4 comprising a horizontal tube having in-line longitudinally spaced apart upwardly facing ports 6 connected to a fuel supply such as a supply of natural gas, the burner 4 being located in the bottom of a vertically and horizontally extending heating chamber 8. The horizontal tube which comprises burner 4 opens to the atmosphere through aperture 9 at one end 10.

The supply of fuel to the burner is controlled by a thermostat 11 and valve 12 in a conventional manner, to shut off the supply of fuel and extinguish the burner when a desired temperature is reached and to open the supply of fuel when temperature drops to a pre-determined level with a conventional spark ignition component 14 to ignite the fuel then being emitted through the ports 6 of the burner 4.

A plurality of horizontally extending coils 16 are connected at their upper ends 18 to the heating chamber 8 near the upper end 20 thereof. Each coil 16 is spaced apart horizontally along the horizontal dimension of the heating chamber 8, and each opens to the heating chamber 8 near its upper end 20. Each coil 16 includes a first top coil section 22 extending substantially normal to the vertically extending heating chamber 8 and outwardly therefrom from its opening 24 to the heating chamber 8 to a first return bend 26, a second coil section 28 below the first coil section and substantially parallel therewith to a second return bend 30 adjacent said heating chamber 8, and successive coil sections 32 and return bends 34 extending in like manner below the said first coil sections 22 and second coil sections 28, finally terminating in outwardly extending bottom coil sections 36 which extend in a direction outwardly from return bends 34 adjacent the heating chamber 8 and which terminate in respective spaced apart openings 38 to a horizontally extending collector tube 40.

The collector tube 40 is closed at one end 42, and opens at the opposite end 44 through aperture 46 to a vertically extending tubular stack 48. The tubular stack 48 is connected at its bottom end 50 to a blower 52, which receives outside air through an intake conduit 54 and blows it upwardly through the tubular stack 48, past the aperture 46 opening to the collector tube 40 and on upwardly for discharge through an exhaust conduit 56 to the outside building environment.

As outside air is blown upwardly through the vertical tubular stack 48 past aperture 46 opening to collector tube 40, a vacuum is created at the aperture 46 which draws heated air through the coils 16 and their respective openings 38 into the collector tube 40 from their respective openings 24 to the upper end 20 of the heating chamber 8. Thus, as air is heated in the vertically and horizontally extending heating chamber 8 by the burner 4, the heated air is drawn from the upper end 20 of the heating chamber 8 into the plurality of horizontally spaced apart coils 16, through the respective vertically spaced apart sections of each coil 16, and eventually through their outlet apertures or openings 38 into the collector tube 40, for eventual entry into and discharge from the vertically extending tubular stack 48.

Thus, coils 16 which are preferably of iron or other heat conductive material absorb and transmit the heat from the heated air leaving heating chamber 8 as it flows from the intake apertures or openings 24 into the respective coils 16 and down through their respective vertically disposed coil sections for discharge through their respective discharge ports or openings 38 into the horizontally extending collector tube 40.

In order to better collect and disseminate the heat from the respective coils 16 to air passing across the coils in an air duct of a hot air heating system, a plurality of aluminum fins 60 are provided which extend transverse to the plurality of spaced apart coils 16, said fins 60 having openings therein to permit passage of the respective coil sections through the aluminum fins 60. The fins 60 comprise a thin sheet of aluminum (or other equally heat conductive material) which extends vertically from the bottom coil section 36 of each coil 16 to the top coil section 22 and which extends horizontally from a first coil section **16*a* at a first side edge 62 to a last coil section 16*b* at a second side edge 64**.

Each of said fins 60 extend upwardly in substantially parallel relationships to the side walls 66 of the heating chamber 8, and they are spaced apart from the heating chamber 8 and from each other outwardly in the direction the coils 16 extend outwardly therefrom. The fins 60 are preferably spaced apart closely to one another to take up the maximum amount of heat from the coil sections of coils 16 passing through said fins 60 and transmit such maximum amount of heat to the air passing over and across the heat exchanger 2 of this invention placed in an air passageway of a hot air heating system.

A damper 68 is provided in the intake conduit 54 to vary the amount of outside air received through the conduit 54, through the blower 52 and past the aperture 46 of the collector tube 40 as the air is directed upwardly through the tubular stack 48 and outwardly through the exhaust conduit 56. Thus, when the damper 68 diminishes the amount of air that can pass, the amount of heated air that can be drawn through the repsective coils 16 is diminished, with the result that less heat is available for transmission to the air flowing past the heat exchanger 2. The converse is true when the damper 68 opens to increase the amount of air that can pass.

The damper 68 is controlled by a sensor of conventional type connected ultimately to the thermostat 11 in a known manner. The damper 68 is controlled in such a way that it will never close completely. A drain tube 70 is provided near the open end 44 of collector tube 40 to drain any condensation which forms in the coils and collector tube.

Figure 7:
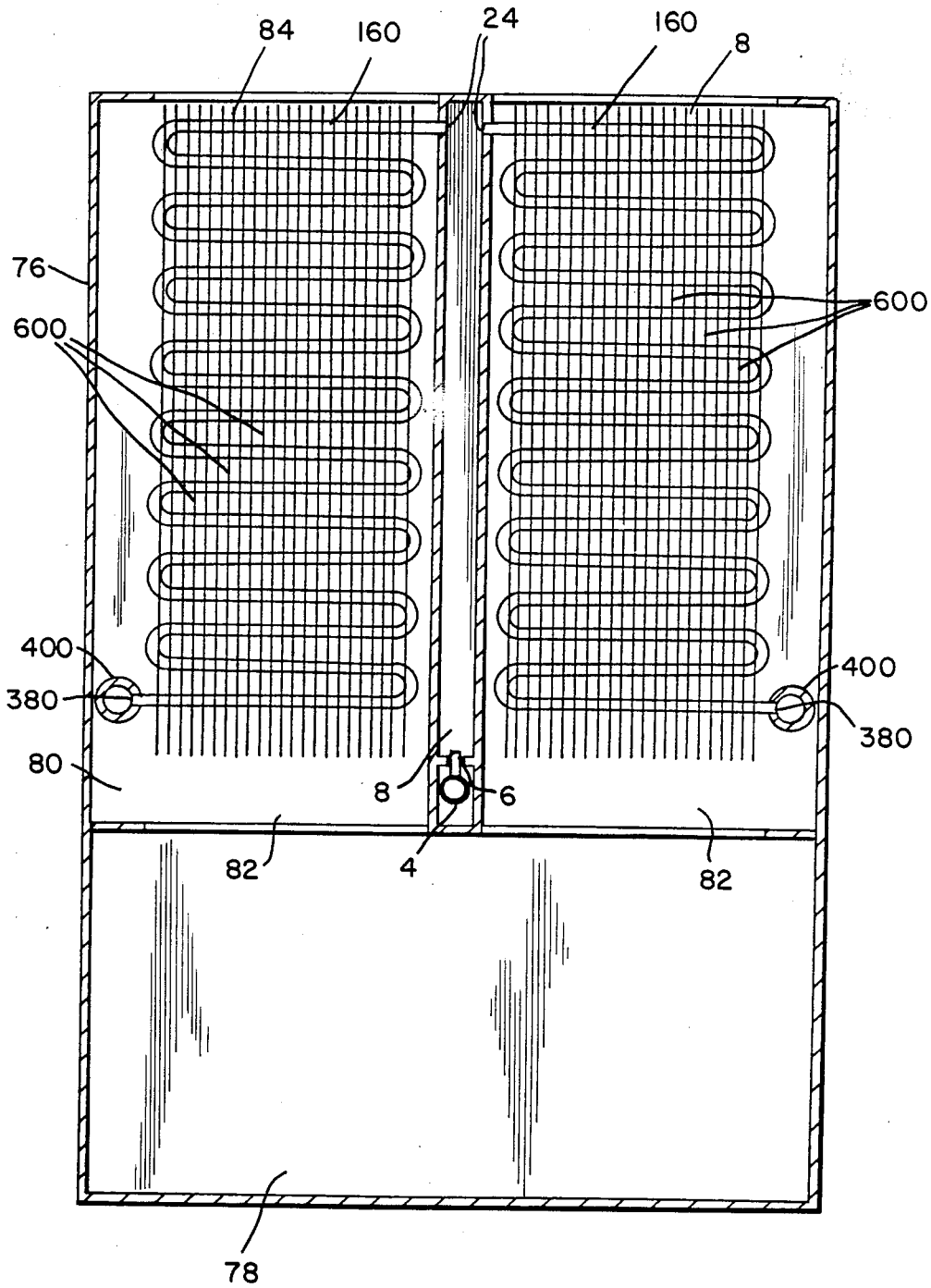
FIG. 7 is a section view of the modification taken on line 7—7 of FIG. 6.

In a modification of the present invention, coils 160 extend outwardly from both vertical side walls 72 and 74 of the heating chamber 8, having similar heat transfer fins 600 extending transverse of the coils 160 to transfer heat therefrom to air passing through an air duct of a hot air heating system. In the modification, the openings 380 of coils 160 open to horizontal collector tubes 400 closed at one end and open at the opposite end 440 through aperture 460 to transverse conduits 480 connected at one end 500 to a blower 520 which receives outside air through intake conduit 540 blowing it transversely in conduits 480 past the apertures 460 through exhaust conduits 560 to the outside environment. A vacuum is thereby created at aperture 460 drawing heated air through the coils 160 to heat the heat transfer fins 600 of the modification. In the modification, a single burner 4 and single heating chamber 8 heats the coils 160 and heat transfer fins 600 to provide a double surface heating area over that of the embodiment originally described. FIG. 7 shows only one blower 520 which is capable of blowing air outwardly therefrom in both opposite directions to thereby create a vacuum force at the apertures 460 of both collector tubes 400. Two separate blowers 52 may of course be used instead for connection separately to each collector tube 400 in the manner previously described.

A significant feature of the present invention is that the longitudinal axis of the tubular stack 48 through which outside air at ambient temperature is blown, is transverse to the central axis through the opening 46 of the collector tube 40 to the tubular stack 48, and creates a vacuum at the opening 46 when outside air is blown through the stack 48. The blower 52 is not in the flow path of the heated air as it flows from the heating chamber 8, through the coils 16 and into the collector tube 40. Cold air being heavier than hot air, the relatively colder air in the tubular stack 48 flowing transversely across the opening 46 to the relatively hotter air in the passageway comprising collector tube 40, coils 16 and heating chamber 8 tends to retard the entry of the hotter air into the tubular stack 48 until its temperature has lowered toward that of the outside air at ambient temperature being blown through the stack 48. This enables the hot air being flowed through the coils 16 to remain in the coils at its own pace long enough for the heat transfer fins 60 to take up most of the heat from the coils and transfer it to heat the air in the air duct of a hot air heating system in which the heat exchanger is placed. In other words, there is no positive propelling force applied upstream to the heated air in the present invention. It is only after such air has passed completely through the heat transfer coils and fins, after the heat transfer portion of the passageway has been completed, and after the originally heated air enters the tubular stack to combine with outside ambient temperature air that the positive propelling force of the blower 52 is applied.

The longitudinal axis of the tubular stack 48 may extend at substantially a right angle to the central axis of the opening 46 to the collector tube 40, although it may extend at other angles which direct the air flow in stack 48 transversely to the opening 46 to collector tube 40.

The heat exchanger 2 in accordance with this invention may be installed in the air passageway of a hot air heating system of the type shown in the drawings, comprising a housing 76 in which to mount the heat exchanger 2 and its associated parts including the blower 52 connected to the collector tube 40. The housing 76 includes a lower compartment 78 in which to mount the main blower (not shown) of the hot air heating system. The lower compartment 78 opens to the upper compartment 80 in which the heat exchanger 2 is mounted through a large opening 82. Air from the main blower is directed through the large opening 82 and upwardly past the heat exchange coils 16 and heat transfer fins 60 of the heat exchanger 2, and then out of the housing 76 through a second large opening 84 in the top wall 86 of the housing 76. A distributing duct may be connected to the housing 76 to receive the heated air being blown through the top opening 84, for distribution of the heated air to any desired location.

I claim:

1. A heat exchanger comprising a heat source to heat gases, a heat transfer assembly having intake means to receive said heated gases from said heat source, heat transfer means to transfer heat from said gases to raise the temperature of items brought into the vicinity of said heat transfer assembly, outlet means to discharge said gases after heat has been transferred therefrom, said heat transfer assembly being vertically positioned having an upper end and a lower end, said outlet means including an outlet conduit terminating at an outlet aperture, said outlet conduit being horizontally disposed when said heat transfer assembly is in said vertical position, said outlet conduit being located nearer said lower end than said upper end of said heat transfer assembly, said outlet conduit having a central axis extending in a first direction, a vacuum creating conduit including an elongated portion having a central axis and positioned relative to said outlet conduit whereby said central axis of said elongated portion of said vacuum creating conduit is in line with said central axis of said outlet conduit and extends in a second direction substantially normal to said first direction, said outlet aperture of said outlet conduit being connected to and opening to said elongated portion of said vacuum creating conduit at an intermediate point thereof spaced apart from each end thereof, said vacuum creating conduit having an intake end portion extending from one end of its said elongated portion and an outlet end portion extending from the opposite end of its said elongated portion, said vacuum creating conduit having a passageway of substantially uniform corss-section and unobstructed from at least its intake end to said intermediate point where said outlet aperture of said outlet conduit opens to said vacuum creating conduit, a relatively low temperature air source, said intake end portion of said vacuum creating conduit having an intake aperture opening to said relatively low temperature air source, said vacuum creating conduit including a blower connected therein at a location between said intake aperture of said intake end portion and the point at which said outlet aperture of said outlet conduit opens to said elongated portion of said vacuum creating conduit, said outlet end portion of said vacuum creating conduit having a discharge aperture, said blower being operative to draw relatively low temperature air from said relatively low temperature source into said intake aperture of said vacuum creating conduit and blow said relatively low temperature air through said vacuum creating conduit past said outlet aperture of said outlet conduit of said heat transfer assembly opening to said vaccum creating conduit in a direction substantially perpendicular to the direction of air flow in said outlet conduit as it passes toward the said outlet aperture of said outlet conduit, a partial vacuum being thereby created at said outlet aperture by operation of said blower to draw gases from said heat transfer assembly after heat has been transferred therefrom, said gases being drawn from said outlet aperture having a relatively higher temperature, said relatively low temperature air in said vacuum creating conduit being heavier than said relatively higher temperature gases at said outlet aperture to retard flow of said gases from said heat transfer assembly until most of the heat has been taken up and transferred by said heat transfer means whereby the temperature of said gases eventually lowers toward that of the relatively low temperature air in said vacuum creating conduit and the weight of said gases increases toward that of said heavier air in said vacuum creating conduit, said gases being thereupon immediately drawn from said heat transfer assembly as soon as their heat has been taken up and transferred making room for newly heated gases to continuously enter said heat transfer assembly as soon as the preceding gases have given up their heat.

2. A heat exchanger as set forth in claim 1, wherein said heat source includes a heating chamber, and a heater to heat gases in said heating chamber.

3. A heat exchanger as set forth in claim 2, wherein said heating chamber is elongated both horizontally and vertically, enclosed by a peripheral wall which includes a first side wall and a spaced apart second side wall extending upright in substantially parallel relationship, said intake means of said heat transfer assembly including at said upper end thereof at least one inlet aperture opening through said first side wall to said heating chamber, said heat transfer means including at least one coiled conduit having a first end connected to said inlet aperture and a second end connected to said outlet conduit at an intermediate outlet aperture, including said intermediate outlet aperture, said intermediate outlet aperture opening to said outlet conduit, said outlet conduit terminating at said outlet aperture which opens to said vacuum creating conduit.

4. A heat exchanger as set forth in claim 3, wherein said heater to heat gases in said heating chamber is a flame burning heater, comprising an elongated tubular portion connected to a source of fuel and a plurality of spaced apart upwardly facing ports for said fuel to pass through for ignition and burning, said flame burning heater being positioned at the bottom end region of said heating chamber.

5. A heat exchanger as set forth in claim 3, wherein said intake means of said heat transfer assembly includes a plurality of inlet apertures at the upper end thereof opening through said first side wall to said heating chamber, said heat transfer means includes a corresponding plurality of coiled conduits having respective first ends connected to corresponding ones of said inlet apertures and respective second ends connected to a corresponding plurality of intermediate outlet apertures, including said plurality of intermediate outlet apertures, said intermediate outlet apertures each opening to said outlet conduit at spaced apart locations therealong.

6. A heat exchanger as set forth in claim 5, wherein said coiled conduits each includes a first coiled conduit section which extends outwardly from said first side wall substantially perpendicular thereto to an outer end region, a second coiled conduit section spaced apart below said first coiled conduit section in substantially parallel relationship thereto extending from an outer end region to an inner end region adjacent said first side wall of said heating chamber, a first return bend conduit portion connecting said first and second coiled conduit sections at their respective outer end regions, a third coiled conduit section spaced apart below said second coiled conduit section in substantially parallel relationship thereto extending from an inner end region adjacent said first side wall of said heating chamber to an outer end region, a second return bend conduit portion connecting said second and third coiled conduit sections at their respective inner ends, said outer end region of said third coiled section of each of said coiled conduits terminating at respective ones of said intermediate outlet apertures opening to said outlet conduit.

7. A heat exchanger as set forth in claim 6, wherein said plurality of coiled conduits each extend in one-section-above-the-other alignment in one direction, each of said coiled conduits being spaced apart from and substantially parallel to each other, said heat transfer means including a plurality of heat transfer fins, each comprising a thin sheet of heat conductive material, said heat transfer fins having apertures spaced apart and located for alignment with respective ones of said coiled conduit sections to receive said respective sections through said apertures to mount said heat transfer fins on said plurality of coiled conduits to extend in a direction substantially normal to said one direction, said heat transfer fins being closely spaced apart on said coiled conduits from their outer end regions to their inner end regions.

8. A heat exchanger as set forth in claim 5, wherein said outlet conduit includes a drain port to drain any condensate which may collect therein from said coiled conduits whose intermediate outlet apertures open thereto.

9. A heat exchanger as set forth in claim 5, wherein said intake means of said heat transfer assembly includes a plurality of opposite side inlet apertures opening through said opposite second side wall to said heating chamber, said heat transfer means includes a corresponding plurality of opposite side coiled conduits having respective first ends connected to corresponding ones of said opposite side inlet apertures and respective second ends connected to a corresponding plurality of opposite side intermediate outlet apertures, including said plurality of opposite side intermediate outlet apertures, said opposite side intermediate outlet apertures each opening to an opposite side outlet conduit, including said opposite side outlet conduit, said opposite side outlet conduit having an outlet aperture having a central axis extending in one direction, an opposite side vacuum creating conduit having a longitudinal axis extending in a direction perpendicular to said one direction, said opposite side vacuum creating conduit being connected to said blower and being open at one end to said relatively low temperature air source, said outlet aperture of said opposite side outlet conduit opening to said opposite side vacuum creating conduit at a location between said blower and said one end.

* * * * *